United States Patent [19]

Vann et al.

[11] Patent Number: 4,598,775

[45] Date of Patent: Jul. 8, 1986

[54] PERFORATING GUN CHARGE CARRIER IMPROVEMENTS

[75] Inventors: Roy R. Vann; Edward A. Colle, Jr., both of Houston, Tex.

[73] Assignee: Geo. Vann, Inc., Houston, Tex.

[21] Appl. No.: 756,531

[22] Filed: Jul. 19, 1985

Related U.S. Application Data

[63] Continuation of Ser. No. 385,463, Jun. 7, 1982, abandoned.

[51] Int. Cl.[4] ..... E21B 43/117

[52] U.S. Cl. ..... 175/4.6; 102/310; 102/321

[58] Field of Search ..... 175/4.51–4.54, 175/4.6; 166/297, 55, 55.1; 102/310–313, 319–323

[56] References Cited

U.S. PATENT DOCUMENTS

| | | | |
|---|---|---|---|
| 177,808 | 4/1964 | Owens | 102/310 |
| 2,686,472 | 8/1954 | Burns | 175/4.6 |
| 2,750,884 | 6/1956 | Gaines | 102/321 |
| 2,764,938 | 10/1956 | Harcus | 175/4.6 |
| 3,104,611 | 9/1963 | Baks | 102/310 |
| 3,773,119 | 11/1973 | Shore | 175/4.6 |
| 4,191,265 | 3/1980 | Bosse-Platiere | 175/4.6 |

*Primary Examiner*—James A. Leppink
*Assistant Examiner*—Thuy M. Bui
*Attorney, Agent, or Firm*—James R. Duzan

[57] ABSTRACT

A perforating gun has a charge carrier assembly housed therein comprised of a plurality of charge holders connected together in tandem. Shaped charges are supported within each of the charge holders, such that the corresponding charges of each holder are circumferentially and vertically spaced apart from one another to forn a predetermined pattern. The individual charge holders describe a polyhedron whose bases or ends describe equal polygons, and whose lateral faces are rectangular and include a centrally located aperture which is adapted to receive a shaped charge in supported relationship therewithin. Each shaped charge is provided with a boss at the forward end thereof which abuttingly engages a lateral face of the polyhedron, and each corner or lateral edge formed between adjacent lateral faces of the charge holders have tabs extended in opposite directions therefrom which are arranged to engage the outmost face of the shaped charge, so that the shaped charge is uniquely captured in mounted relationship within the charge holder only by the action of the action of adjacent charge holders.

13 Claims, 9 Drawing Figures

PERFORATING GUN CHARGE CARRIER IMPROVEMENTS

This application is a continuation of patent application Ser. No. 06/385,463, filed June 7, 1982, now abandoned.

BACKGROUND OF THE INVENTION

Jet perforating guns are used downhole in a cased borehole for perforating the casing at a location adjacent to a hydrocarbon containing formation. Perforating guns include a charge carrier with shaped charges which shoot through the cased borehole and into the formation. The shaped charges are generally loaded into the charge carrier through one end of the carrier or through ports passing through the side of the carrier. Generally the shaped charges are loaded one charge at a time, and port wrenches are used to install the charges in the ports. This requires substantial labor for the loading of the shaped charges. The ports are also used to hold the charges in position and to fix their location within the charge carrier of the perforating gun. Upon detonation of the perforating gun, the shaped charges then shoot through the ports.

Perforating guns must be hermetically sealed to prevent fluids from leaking into the charge carrier and damaging the charges so as to prevent them from detonating. Thus, many seals are required in prior art guns. Rubber jackets are placed around the charges so that the charges will be sealed within the ports. However, these rubber jackets may melt in a high temperature environment such that the seal around the ports is lost if the rubber jackets melt or deform. If such were to occur, the alignment of the charges in the carrier would also be lost. Further, it is possible in a high pressure well that the integrity of the seals of the ports may be broken.

Although charges are often located one above the other in a staggered fashion in the carrier, it is often desirable to load the charges in a cluster circumferentially spaced within the charge carrier. The prior art methods of loading such a plurality of charges in a cluster is very cumbersome. Further, it is necessary that the shaped charge be within a reasonable distance of the prima cord or the charges will not detonate. Thus, it is necessary to squeeze the shaped charge down onto the prima cord in the center of the charge carrier to insure detonation.

In some very small perforating guns with a maximum diameter of two inches, the ports have been eliminated so that the charges shoot directly through the sidewall of the charge carrier. The charges for such small perforating guns are mounted on a member in aligned relationship outside the perforating gun housing and then lowered as a unit into the interior of the gun housing. It is necessary that all the charges be very rigid and locked into place so that they can be lowered into the charge carrier housing as a unit. Thus, small guns require a solid alignment system.

In a high shot density gun, often an aluminum tube is used. Holes are drilled into the sides of the tube for receiving and housing individual shaped charges. Once the charges are inserted into the holes, the charges are banded onto the tube. Further, it is necessary that a hole be drilled all the way through the tube from one end to the other in order to house the prima cord. Such milling, drilling, and machining of the aluminum tube is very cumbersome and expensive.

It is often desirable to obtain a specific perforating pattern by orienting each of the shaped charges to discharge in a specific direction relative to the other charges. The shaped charges are usually placed as close to one another as possible, and each charge therefore is successively rotated about the longitudinal axial centerline of the carrier respective to the next adjacent charge. Vertically spaced adjacent charges of a cluster may be oriented to discharge along radials which diverge 60° apart, for example; and the individual charges of a cluster may be arranged to discharge 120° apart, for example.

As pointed out in U.S. Pat. No. 4,194,577, it is sometimes desirable to orient shaped charges to fire in a downward direction; and, as pointed out in U.S. Pat. No. 4,140,188, it is sometimes desirable to orient the charges to fire radially away from the borehole in a specific pattern. Therefore, it is often desirable to arrange shaped charges in a manner so that when the charges are detonated, they do not interfere with one another, and yet they are grouped as close as possible so as to attain a very dense perforation pattern. In this instance, it is desirable to be able to conveniently and economically mount the shaped charges within a gun housing in a foolproof and structurally safe manner, whereby each of the charges is properly aligned respective to the gun axis and to the borehole axis so that when the gun is detonated, the resultant perforating job achieves the desired result.

A perforating gun which attains the above desirable goals is the subject of the present invention.

SUMMARY OF THE INVENTION

The present invention relates to a perforating gun device which has multiple shaped charges supported in aligned relationship within a housing, and a firing means is connected to detonate the charges, so that the perforating gun can be run downhole into the borehole, positioned adjacent to a hydrocarbon containing formation, whereupon the shaped charges are detonated, thereby perforating the borehole wall and forming tunnels of a predetermined pattern back into the formation so that satisfactory production therefrom is achieved. The perforating gun device includes shaped charges, each having a cylindrical boss at the outer marginal end thereof which is reduced in diameter to form a shoulder. The inner marginal end of the shaped charges is conical in geometrical configuration and terminates in close proximity to the longitudinal axial centerline of a gun, so that detonation means can be provided at the inner end thereof for exploding the shaped charge.

A charge carrier supports the shaped charges within the housing, with each of the individual charges thereof being arranged in groups which are vertically and circumferentially spaced in a predetermined oriented relationship relative to one another. The charge carrier is comprised of a plurality of individual coacting charge holders releasably connected in tandem along the longitudinal axial centerline of the gun device. Each charge holder is a polyhedron whose bases or opposed ends describe equal polygons, and whose lateral faces are apertured rectangles of a size to slidably receive the reduced diameter portion of the cylindrical body portion of the shaped charge in close tolerance relationship therewithin.

The lateral edge which interconnects the lateral faces of the polygon are extended longitudinally in opposition to one another to form opposed tabs. The tabs extend beyond the lateral faces of the polygon and are positioned respective to an adjacent charge holder to bear against the face of a shaped charge contained therein. The adjacent charge holders are axially rotated relative to one another to bring the terminal edges of adjacent holders into interfering engagement with one another. The tab of one holder is extended in overlying relationship relative to the outer face of a shaped charge supported within the apertured lateral face. Accordingly, the shaped charge is captured within a charge holder between the face of the charge holder, within which it resides, and the extended tabs of the two adjacent charge holders.

Each charge holder has a cutout formed in opposed marginal terminal ends of a lateral face, which cooperates with the nearest adjacent similary formed lateral face of an adjacent charge holder in a manner to cause each of the holders to be releasably locked together and to be axially rotated respective to one another an amount equal to 180° divided by the number of lateral faces, so that when the holders are placed in tandem and rotated the appropriate amount with respect to one another, the slots of adjacent holders lock or cooperate together to maintain each of the holders oriented respective to one another to position each charge of the gun vertically and axially from the next vertically adjacent spaced charge.

Accordingly, a primary object of the present invention use the provision of a method and apparatus by which the shaped charges within a jet perforating gun are supported within a gun housing in a number of different predetermined patterns.

Another object of the present invention is the provision of a charge holder having the flexibility to carry a cluster of three shaped charges in a preferred radial alignment. The present invention permits the clustering of charges so that there may be twelve charges per foot of perforating gun.

Another object of the present invention is the provision of a charge carrier comprised of a plurality of charge holders which can be assembled to one another in series relationship so that the shaped charges carried by the series connected charge holders are vertically and axially spaced from one another in a predetermined geometrical pattern.

Still another object of the present invention is the provision of a jet perforating gun having a charge carrier made of a plurality of charge holders which can be assembled to provide a gun of any desired length.

An additional object of the present invention is the provision of an improved jet perforating gun having a charge carrier housed therewithin which is made into a configuration whereby the shaped charges thereof are captured therewithin in a manner to provide a specific casing penetration pattern.

A further object of the present invention is the provision of a new combination of elements which provides a jet perforating gun having a charge carrier made up of individual identical charge holders which are series connected to orient the shaped charges thereof to fire in a particular pattern.

Another object of the present invention is the elimination of the necessity of ports in the charge carrier for mounting the charges whereby the interior of the charge carrier may be increased substantially and the use of a port wrench may be eliminated for loading the charges, thus substantially reducing the required labor.

An additional object of the present invention is the elimination of port plugs from a gun housing so that the shaped charges can be shot through the housing wall of the perforating gun. If the charges are not fired through the wall, they can be fired through a plug. Further, the housing may be scalloped or thinned at the location of the exit of the shaped charges upon detonation, thus reducing the resistance to the penetration of the shaped charge through the charge carrier upon detonation.

The present invention further includes charge holders which automatically index the shaped charges so that they may be easily aligned with the scallops or plugs in the charge carrier.

An additional object of the present invention is the econominization of space inside the charge carrier permitting the use of larger shaped charges.

A further object of present invention is the elimination of all seals but two, one at each end. Only two seals are required since there are no ports in the housing for loading the charges into the guns. The elimination of sealed ports also avoids any leakage problem.

The invention has good temperature, pressure, and drop test characteristics thereby providing a very rugged system.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENT

Figure 1:
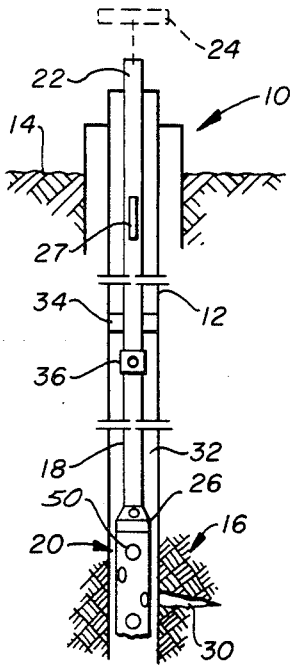
FIG. 1 is a diagrammatical representation of a borehole formed into the earth and having a jet perforating gun disposed therein made in accordance with the present invention.

In FIG. 1, there is disclosed a wellhead 10 located at the top of a cased borehole 12 which extends down from the surface 14 of the ground to a hydrocarbon containing formation 16. A tubing string 18 supports a jet perforating gun 20, made in accordance with the present invention, from the lower end thereof. The upper end of the tubing string terminates in the form of a lubricator 22, the details of which are known to those skilled in the art. Numeral 24 broadly indicates apparatus for manipulating the tubing string 18.

The jet perforating gun 20 includes a gun firing head 26 which can be detonated by dropping a bar 27 down through the tubing string 18, or by a number of different means, as taught in Vann U.S. Pat. Nos. 4,194,577; 4,140,188; 4,009,757; 3,990,507; 3,912,013; 3,758,731; 3,717,095; 3,717,099; and 3,706,344 to which reference is made for further background of this invention. Reference is also made to the art cited therein.

A plurality of shaped charges 50 is contained isolated within the gun 20 and is detonated whenever the gun firing head 26 is actuated. The individual shaped charges 50 perforate the casing 12 and form a tunnel 30 back into the formation 16. The annulus 32 formed by casing 12 and tubing string 18 is divided into an upper and lower annulus by packer device 34. Vent assembly 36 underlies packer device 34 for purposes known to those skilled in the art, and as set forth in the Vann U.S. Pat. Nos. 3,931,855; 4,040,485; and 4,151,880, for example. Hence, FIG. 1 sets forth one of several systems within which the present invention can be used to advantage.

Figure 2:
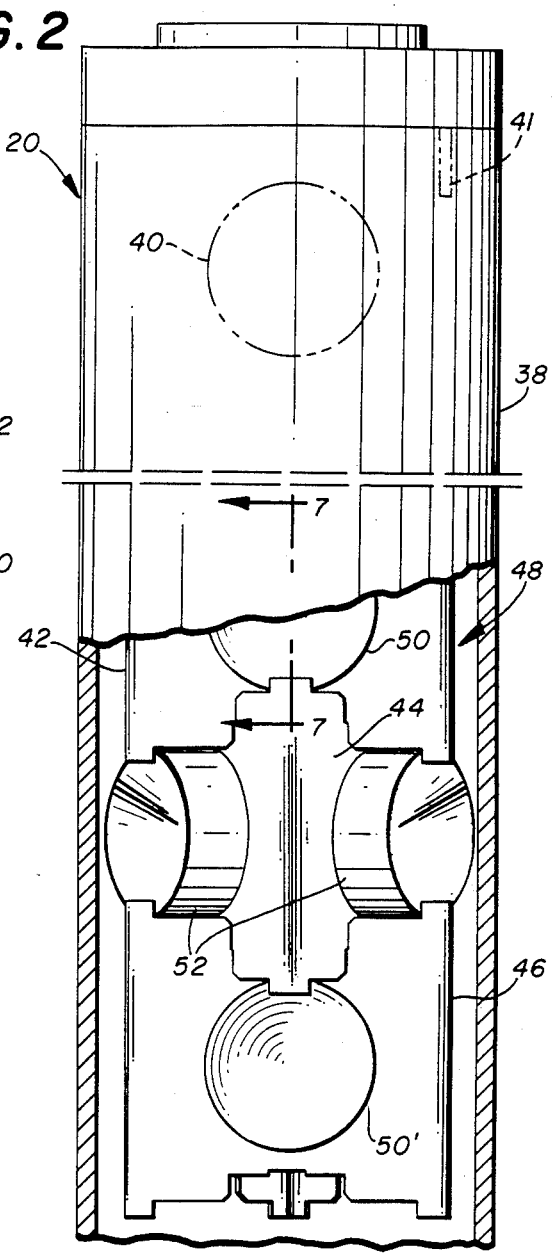
FIG. 2 is a fragmentary, part cross-sectional, enlarged, side elevational view of the jet perforating gun seen in FIG. 1.

Referring now to FIG. 2, together with other figures of the drawings, there is more fully disclosed the details of the before mentioned jet perforating gun 20. The gun 20 includes a housing 38 which can be interrupted by plugged ports or windows shown at 40 or scallops or thinned areas located at 40 through which the shaped charges 50 penetrate upon detonation, or alternatively the housing 38 can be made continuous with charges 50 penetrating directly through housing 38 upon detonation and disposed of after each use, as may be deemed desirable. Numeral 41 broadly indicates a pin means by which the charge carrier of the present invention is maintained aligned respective to ports or scallops at 40, when the pots or scallops are employed.

It is preferred to use a housing 38 with a continuous surface, or scalloped surface or thinned surface at 40 rather than a housing having plugged ports or windows. The elimination of plugged ports or windows eliminates the need for seals at the ports or windows which may leak, thereby damaging the shaped charges 50. Thus, the gun 20 only requires two seals, one at each end of housing 38. The elimination of plugged ports also increases the size of the interior of housing 38 permitting the use of larger shaped charges for deeper penetration into the formation. Also elimination of the port plugs substantially decreases labor time for loading.

Figure 5:
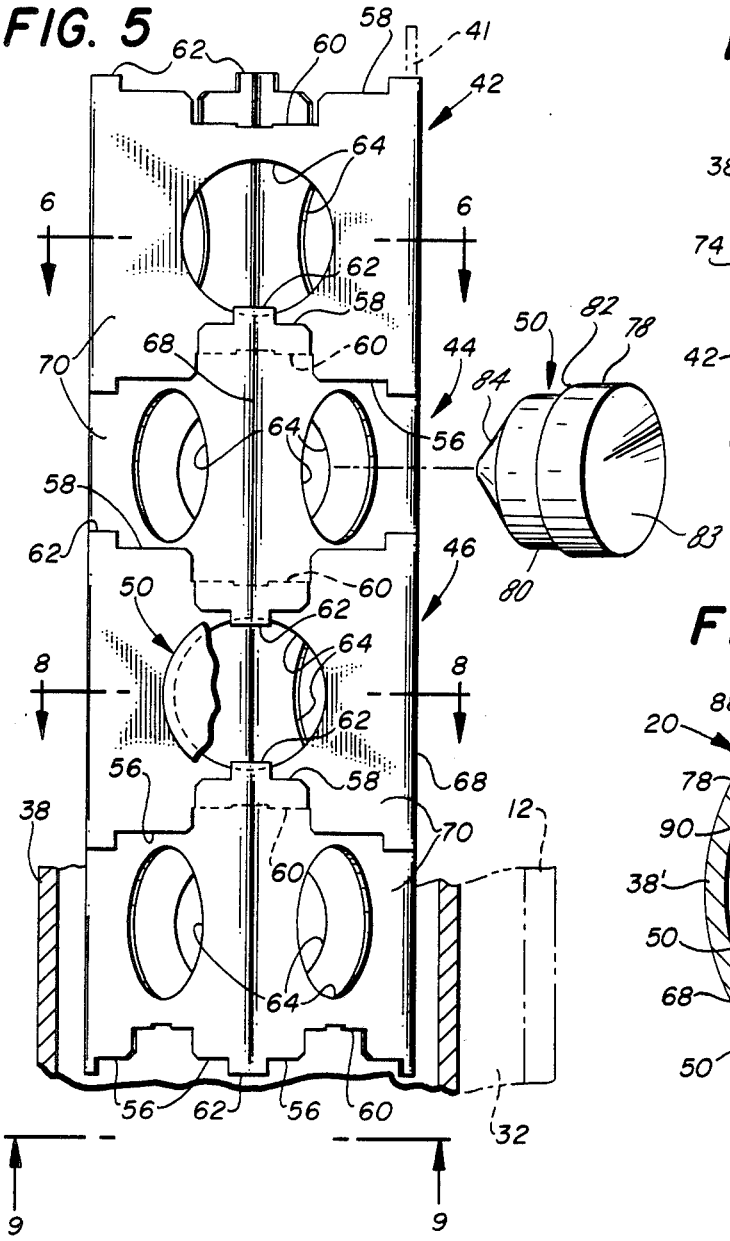
FIG. 5 is a side elevational view of the stacked charge holders of the gun disclosed in FIG. 2.

A plurality of charge holders, some of which are seen at 42, 44, and 46 in FIG. 5, is placed in tandem along the longitudinal axial centerline of the gun 20, and jointly cooperates together to make up a charge carrier 48 shown in FIG. 2.

Each of the individual charge holders, 42, 44, 46, preferably includes at least one shaped charge 50 mounted thereto. In the specific embodiment set forth herein, there is disclosed a plurality of shaped charges 50 for each of the plurality of charge holders 42, 44, 46 that jointly make up the charge carrier 48.

Figure 3:
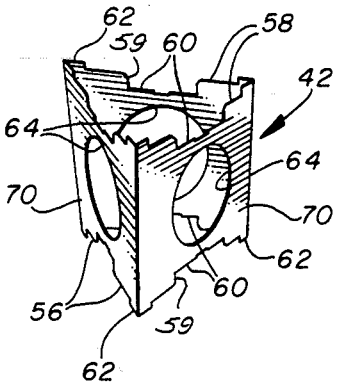
FIG. 3 is a reduced, perspective view of the charge holder of the gun disclosed in FIG. 2.
Figure 4:
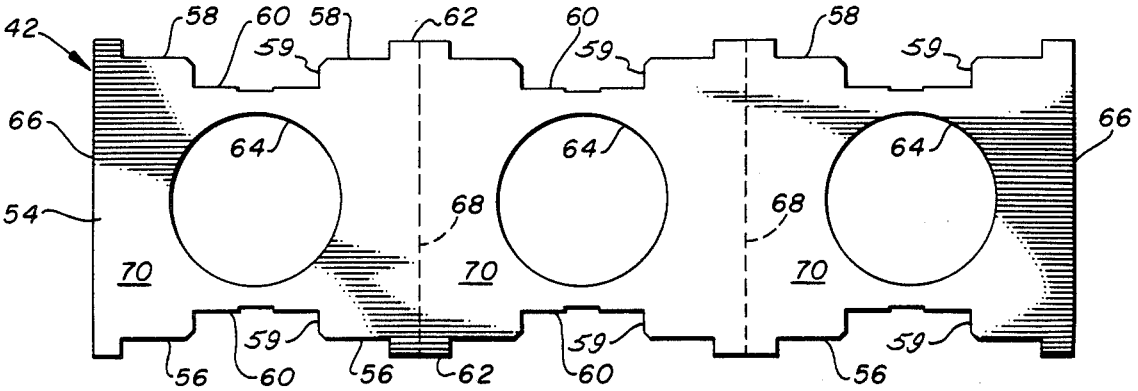
FIG. 4 is an enlarged detailed view of the charge holder disclosed in FIG. 3, showing the method of fabrication thereof.

Referring now to FIGS. 3 and 4, these Figures set forth the details of charge holder 42. The charge holder 42 of FIG. 3 can be fabricated in the manner of FIG. 4, which discloses an elongated, flat piece of metal 54 having a lower edge 56 and an upper opposed edge 58. Spaced cut-outs 60 are formed along the upper and lower edges to provide upper and lower diametrically opposed slots 59 therein. Opposed tabs 62 extend uphole and downhole from the edges of the charge holder 42. Centrally located apertures 64 are formed between the opposed cutouts 60 for receiving the cylindrical body portion of a shaped charge 50 therewithin, in a manner that will be better appreciated later on when the remainder of this disclosure has been more fully digested.

Figure 7:
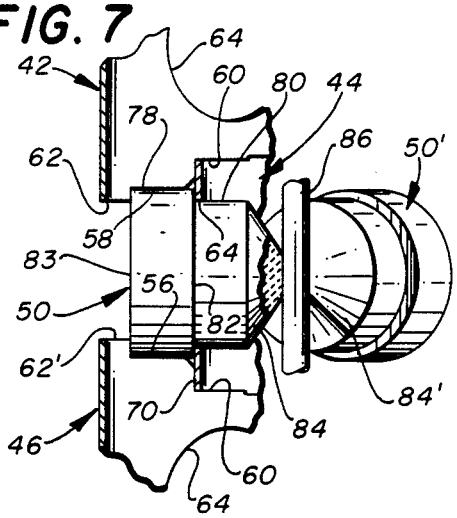
FIG. 7 is a fragmented, part cross-sectional view showing additional details of FIG. 5.
Figure 6:
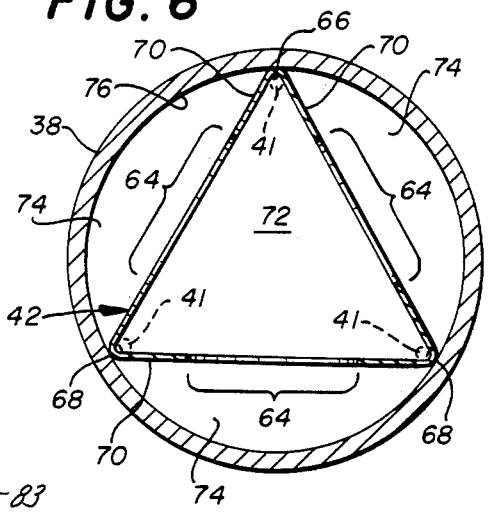
FIG. 6 is a cross-sectional view, taken along line 6—6 of FIG. 5.
Figure 8:
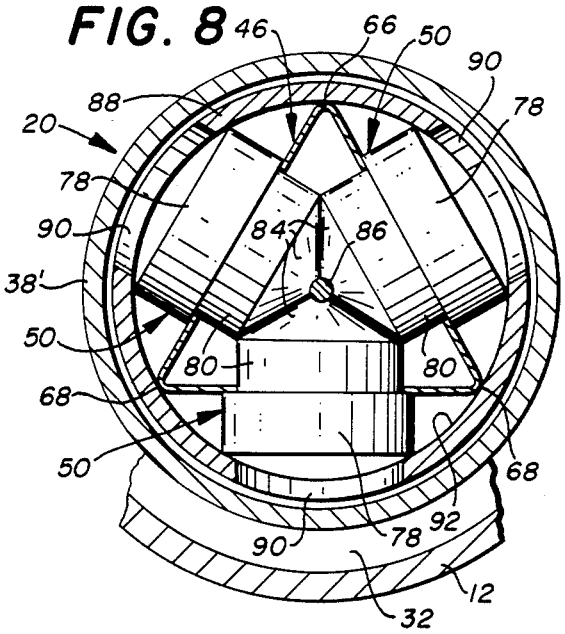
FIG. 8 is a cross-sectional view taken along line 8—8 of FIG. 5.
Figure 9:
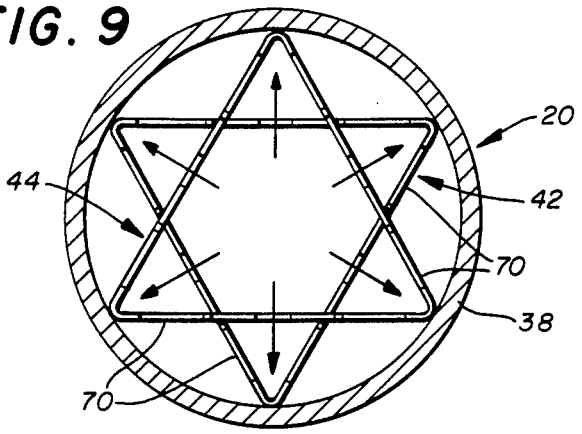
FIG. 9 is an end view looking in the direction indicated by the numerals 9—9 of FIG. 5.

Opposed side edge portions 66 are attached to one another by bending the illustrated vertical medial areas 68 into an acute angle of 60° so that the faces 70 form the lateral faces of a right triangular prism, as noted in FIGS. 3, 6 and 9. The edge portions 66 and 68 form the lateral edges of the prism, as best disclosed in FIGS. 3 and 6. In FIG. 6, the inner triangular cross-sectional area 72 receives the rear or inner marginal body portion of a shaped charge 50 therewithin in the illustrated manner of FIGS. 5 and 8. As best seen in FIGS. 7 and 8, each of the shaped charges 50 includes an outer marginal length in the form of a boss 78, which is reduced in diameter to form a cylindrical medial body portion 80, thereby leaving a rearwardly facing shoulder 82 opposed to the front face 83 of the shaped charge 50. The innermost marginal end portion 84 preferably is made conical with the terminal end thereof being formed into a receptacle which captures a length of explosive prima cord 86 therewithin, in cooperation with other abutting ends of the illustrated radially spaced shaped charges. The prima cord is laid between the adjacent ends of charges 50 and is threaded through holders 42, 44, 46.

The jet perforating gun charge holders 42, 44, 46 of the present invention can be made of stamped-out sheet metal, as set forth in FIG. 4, or alternatively, the individual charge holders can be extruded aluminum or plastic. The gun 20 can be made disposable in the manner of FIG. 6, wherein the gun housing 38 directly and telescopingly receives the charge carriers therewithin, as contrasted to FIG. 8 wherein the gun housing 38' receives the cylindrical body portion 88 having windows 90 aligned with the individual shaped charges. Accordingly, in the embodiment of FIG. 8, the charge carrier 48 and envelope 88 can be reused many times, with only the outer housing 38' being replaced after penetration thereof.

Those skilled in the art, having fully digested the above description of the jet perforating gun 20 of this invention, will appreciate that this invention comprehends a charge carrier 48, suitably housed in housing 38, which is comprised of a plurality of charge holders 42–46, each of which is releasably connected in tandem relative to one another, and axially rotated with respect to one another. Each charge holder describes a polyhedron, preferably a right triangular prism, whose lateral faces are square or assume the form of a parallelogram.

A centrally located aperture 64 is formed perpendicularly through each lateral face 70 and perpendicularly relative to the longitudinal axial centerline of the gun housing 38.

Referring to FIG. 5, the upper and lower marginal edges 58, 56 of each lateral face 70 receive a slot 59, or cutout 60, so that when the charge holders 42, 44, 46 are assembled together into the charge carrier 48, the tabs 62 formed by the extended lateral edges 56, 58 are aligned in overhanging relationship relative to the central lateral face 70 of the two adjacent charge holders, thereby positioning the confronting tabs 62 of alternate charge holders 42, 44, 46 positioned along a line spaced forwardly of the apertures 64 of said alternate charge holders, which places the tabs 62 against the forward face of a shaped charged 50 located in the aperture 64 of the charge holder.

This assembled relationship brings the opposed upper and lower slots 59 of one charge carrier into engagement with the two slots of two connected lateral faces of each adjacent charge holder, and presents a releasable fastener means by which each charge holder is releasably attached to an adjacent charge holder. Any desired number of charge holders can be connected together in this manner. Thus, tabs 62 and cut outs 60 cooperate to align the charges 50 within gun 20 in a predetermined pattern. Any number of holder may be used so that housing 38 may be of any desired length.

The vertically spaced adjacent shaped charges 50 are rotated relative to one another an amount equal to 360° divided by the number of lateral faces divided 2, or 180° divided by the number of lateral faces. Hence, the right triangular prism configuration seen in the instant drawings arranges the circumferentially spaced charges of one holder 120° apart, and arrange vertically spaced charges of adjacent holders to fire along a line of divergence of 60°. The holders automatically index the charges to the desired position.

The charge holders economize on space within housing 38 permitting the use of larger shaped charges. The charges may be clustered so that there may be twelve charges per foot of housing 38. Further, the holders permit the gun 20 to have good temperature, pressure and drop test characteristics.

It is considered within the comprehension of this invention to aperture only one or two of the three lateral faces, and to sometimes leave the charge holders blank. Sometimes it is necessary to space the charges further apart and this is accomplished by making the lateral faces into a long parallelogram to achieve this desired spacing.

While a preferred embodiment of the invention has been shown and described, modifications thereof can be made on one skilled in the art without departing from the spirit of the invention.

We claim:

1. In a perforating gun for perforating a casing located downhole in a cased borehole, said gun having a housing, shaped charges in said housing spaced from one another and connected to a detonation means, each shaped charge having a flange means on one end of a body portion, the other end of the body portion being the detonator end, the combination with said housing, charges, and detonation means of a charge carrier assembly;

said charge carrier assembly comprises a plurality of charge holders connected together along the longitudinal axis of the gun; each charge holder describes a polyhedron, each polyhedron being described by relatively thin wall surfaces joined together by lateral edges which extend parallel to the axial centerline of said gun and provide opposed fasteners for the shaped charge;

each said charge holder has a plurality of lateral faces, one said face is apertured to telescopingly receive a shaped charge therewithin, adjacent charge holders have means for orienting the shaped charges of alternate charge holders in different radial directions; and means for capturing a shaped charge within an aperture of a charge holder whereby the body portion of each said shaped charge is received within said aperture of said charge holder with the flange means of said shaped charge abutting a lateral of said charge holder, and having the opposed fasteners extending towards an opposed fastener located on an alternate charge holder to capture the flange between two opposed fasteners and the lateral face of the charge holder so that the inner detonator end of the charge is positioned near the geometrical center of the charge holder.

2. The combination of claim 1 wherein the lateral faces of said charge holder have said aperture formed centrally therein for receiving said shaped charge in mounted relationship therein;

the lateral edges between adjacent lateral faces of a charge holder are extended in opposition to one another beyond said lateral face and extend into a position respective to the faces of adjacent charge holders to engage the outer end of a shaped charge located in an aperture of said adjacent charge holders to capture the charge within said aperture.

3. The combination of claim 2 wherein each shaped charge has an outwardly directed flange formed at the outer marginal end thereof which abuttingly engages the lateral face of the charge holder;

the lateral edges of alternate charge holders extend towards one another and into contact with the front face of said shaped charge so that the flange is held between the extended lateral edges and the apertured lateral face.

4. The combination of claim 1 wherein said polyhedron is a right triangular prism having three lateral faces and three lateral edges, so that the charges of a charge holder are arranged 120° apart and the charges of the adjacent upper and the lower charge holders are oriented 60° respective thereto.

5. The combination of claim 4 wherein the prismatic type charge holder is made from a stamped, bent-up, piece of sheet metal folded along said lateral edges into the recited configuration.

6. The combination of claim 5 wherein said charge holder has relatively thin walls, the lower corners formed between adjacent lateral faces form an apex of a triangle and extend in opposition to form said tab.

7. The combination of claim 1 wherein each shaped charge has an outwardly directed flange formed near the outer face thereof which abuttingly engages the face of the charge carrier;

the tabs of adjacent charge carriers extend towards one another and in front of said shaped charge so that the outer marginal end of the shaped charge is held between the confronting tabs and the apertured face.

8. A perforating gun device having multiple shaped charges supported in aligned relationship within a housing, and a firing means connected to detonate the charges, the improvement comprising:

each of said shaped charges has a boss formed at the outer end thereof which is reduced to a medial body portion to form a rearwardly directed flange, the inner end of the charge is adapted to detonate the shaped charge;

a charge carrier for supporting the shaped charges within the housing, with each charge being vertically and circumferentially spaced in oriented relationship respective to one another;

said charge carrier is assembled from a plurality of charge holders releasably connected together in tandem along the longitudinal axial centerline of the gun device; each charge holder is a polyhedron and includes an apertured lateral face for slidably receiving the body of a shaped charge in close tolerance telescoping relationship therein so that the inner end of the shaped charge is located near the longitudinal axis of the gun, and the flange of the shaped charge abuttingly engages the periphery of the face about the aperture to thereby limit the entrance of the charge into the charge holder; and means for fastening the charge to said lateral face to prevent outward movement of the charge through the aperture.

9. The improvement of claim 8 wherein said fastener means includes a tab means formed on each said charge holder which extends into engagement with the outer face of the shaped charge to thereby capture a shaped charge respective to the charge holder.

10. The improvement of claim 9 wherein said polyhedron is a right triangular prism having relatively thin walls, the lateral edges of the prism form an apex, each of which extend in opposition to one another and beyond the face to form said tab.

11. The improvement of claim 9 wherein slots are formed in the medial upper edge portion of each lateral face, said slot of one face interengages with the slots on two adjacent faces of another charge holder to index one charge holder with an adjacent charge holder.

12. The improvement of claim 8 wherein said fastener means includes a tab means formed on each charge holder which extends into engagement with the outer face of the shaped charge, to thereby capture a shaped charge within the aperture and respective to the charge holder;

said polyhedron is a right triangular prism haing relatively thin walls, the lateral edges of the prism form a carrier which extends in opposition to one another and form a tab;

said slots are formed in the medial upper and lower edge portion of each lateral face, said slots of one charge holder interengage with the slots located on two lateral faces of an adjacent holder to releasably hold one charge holder oriented in indexed relationship respective to another charge holder.

13. In a perforating gun having shaped charges housed therewithin, the method of arranging the shaped charges to perforate a borehole wall in a specific pattern, comprising the steps of:

forming each charge holder into the configuration of a right triangular prism having lateral faces which describe a parallelogram;

centrally aperturing the lateral face and mounting the shaped charge within said aperture;

extending the lateral edges between lateral faces beyond said lateral faces;

axially aligning a plurality of charge holders within the housing and fastening the charge holders together in indexed relationship so that one charge of a holder is rotated axially respective to the corresponding charge of an adjacent holder;

capturing the individual charges within a holder by fastening the outer marginal end of the charge to the outer extremity of the holder; and orienting the adjacent charge holders to cause the extended lateral edges to abuttingly engage the outer face of a shaped charge supported within the aperture of an adjacent charge holder.

* * * * *